US008596458B1

(12) United States Patent
Alcorn et al.

(10) Patent No.: US 8,596,458 B1
(45) Date of Patent: Dec. 3, 2013

(54) TRAVELER'S HYGIENIC TOTE

(76) Inventors: Robert F. Alcorn, Athens, AL (US); Gary N. James, Falkville, AL (US)

( * ) Notice: Subject to any disclaimer, the term of this patent is extended or adjusted under 35 U.S.C. 154(b) by 371 days.

(21) Appl. No.: 13/135,635

(22) Filed: Jul. 11, 2011

(51) Int. Cl.
*B65D 69/00* (2006.01)

(52) U.S. Cl.
USPC ..... 206/581; 206/38; 206/229

(58) Field of Classification Search
USPC ..... 206/38, 581, 229, 225, 562, 563, 564; 190/127; 150/106, 107, 113; 383/76, 383/104, 121.1
See application file for complete search history.

(56) References Cited

U.S. PATENT DOCUMENTS

| | | | | | |
|---|---|---|---|---|---|
| 180,650 | A | * | 8/1876 | Scheel | 206/225 |
| 853,300 | A | * | 5/1907 | Erickson | 38/142 |
| 1,206,276 | A | * | 11/1916 | Wallach | 190/109 |
| 1,283,170 | A | * | 10/1918 | Hauser | 206/278 |
| 1,436,316 | A | * | 11/1922 | Koenig | 131/239 |
| 1,633,991 | A | * | 6/1927 | Lifton | 190/115 |
| 1,641,650 | A | * | 9/1927 | Walker | 132/315 |
| 2,911,024 | A | * | 11/1959 | Miceli | 150/113 |
| 3,114,457 | A | * | 12/1963 | Knapp et al. | 206/564 |
| 3,425,472 | A | * | 2/1969 | Marino | 206/599 |
| 3,442,437 | A | * | 5/1969 | Mann | 383/10 |
| 3,491,875 | A | * | 1/1970 | Fischer et al. | 206/229 |
| D264,525 | S | * | 5/1982 | Page, Jr. | D12/419 |
| 4,512,503 | A | * | 4/1985 | Gioso | 224/539 |
| D292,135 | S | | 9/1987 | Grube et al. | D34/24 |
| 4,718,524 | A | | 1/1988 | Crumley | |
| 4,807,760 | A | * | 2/1989 | Sussman | 206/581 |
| 4,988,216 | A | * | 1/1991 | Lyman | 383/74 |
| 5,019,124 | A | * | 5/1991 | Flugger | 206/564 |
| D323,051 | S | | 1/1992 | Baggott | D34/19 |
| D328,184 | S | | 7/1992 | Krugman | D3/285 |
| D336,706 | S | | 6/1993 | Lechman et al. | D34/20 |
| 5,217,119 | A | * | 6/1993 | Hollingsworth | 206/583 |
| D355,289 | S | | 2/1995 | Schafer | D34/1 |
| 5,441,152 | A | * | 8/1995 | Estes | 206/570 |
| 5,465,438 | A | | 11/1995 | Allman et al. | 4/626 |
| D375,835 | S | | 11/1996 | Christopher et al. | D3/289 |
| D383,581 | S | | 9/1997 | Ordonez | D34/5 |
| 5,881,788 | A | | 3/1999 | Hersh et al. | |
| 6,000,509 | A | | 12/1999 | Chisholm | |
| 6,068,118 | A | * | 5/2000 | Calloway | 206/233 |
| 6,073,372 | A | * | 6/2000 | Davis | 40/124.16 |
| D440,369 | S | | 4/2001 | LaFollette et al. | D34/19 |
| 6,460,697 | B1 | * | 10/2002 | Stevens | 206/225 |
| 6,491,074 | B1 | | 12/2002 | Roegner | |
| D468,881 | S | | 1/2003 | Cox | D34/19 |
| 6,523,653 | B2 | | 2/2003 | Roegner | |
| 6,599,015 | B1 | * | 7/2003 | Bogatez | 383/6 |
| D548,920 | S | | 8/2007 | Kinsley et al. | D34/27 |
| D557,870 | S | | 12/2007 | MacMillan | D34/14 |
| D604,022 | S | | 11/2009 | Abel et al. | D34/17 |

(Continued)

*Primary Examiner* — David Fidei
(74) *Attorney, Agent, or Firm* — Richard L. Miller

(57) ABSTRACT

A portable, sanitary, and self-closing carrier for having all hygienic supplies required by a traveler using a public toilet readily accessible to the traveler in one convenient place. The carrier includes a tote bag, a tray, and a handle. The tote bag is portable and sanitary. The tray is replaceably contained within the tote bag and has all of the hygienic supplies required by the traveler using the public toilet readily accessible to the traveler in the one convenient place. The handle extends from the tote bag and is so configured so as to allow the tote bag to close when the tote bag when the handle is lifted during carrying so as to allow the tote bag to be self-closing.

19 Claims, 5 Drawing Sheets

(56) References Cited

U.S. PATENT DOCUMENTS

| | | | | |
|---|---|---|---|---|
| D607,172 | S | 12/2009 | Catron | D34/14 |
| 7,682,080 | B2 * | 3/2010 | Mogil | 383/110 |
| D621,569 | S | 8/2010 | Linnell, Jr. | D34/19 |
| D624,724 | S | 9/2010 | Uhl et al. | D34/17 |
| D625,895 | S | 10/2010 | Musi | D34/24 |
| 7,845,377 | B2 * | 12/2010 | Edwards et al. | 150/152 |
| D642,764 | S | 8/2011 | Elden | D34/24 |
| 2002/0005372 | A1 | 1/2002 | Cook et al. | |
| 2003/0103691 | A1 * | 6/2003 | Adams | 383/38 |
| 2005/0218033 | A1 | 10/2005 | Curtis | |
| 2007/0062622 | A1 * | 3/2007 | Groover | 150/113 |
| 2007/0095693 | A1 * | 5/2007 | De Luca | 206/389 |
| 2007/0151895 | A1 * | 7/2007 | Patterson | 206/581 |
| 2007/0183691 | A1 * | 8/2007 | Finnegan | 383/23 |
| 2007/0205118 | A1 * | 9/2007 | Westendorf et al. | 206/229 |
| 2009/0090443 | A1 * | 4/2009 | Preciado et al. | 150/113 |
| 2010/0236673 | A1 * | 9/2010 | Groover | 150/104 |
| 2011/0100865 | A1 * | 5/2011 | Brink et al. | 206/581 |
| 2011/0168720 | A1 * | 7/2011 | Mesman | 220/528 |

* cited by examiner

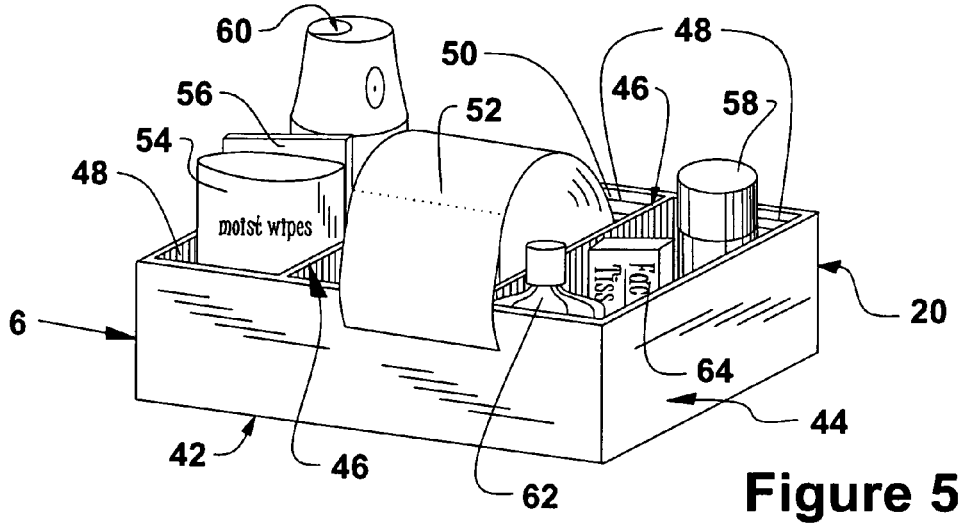
Figure 5
Figure 2
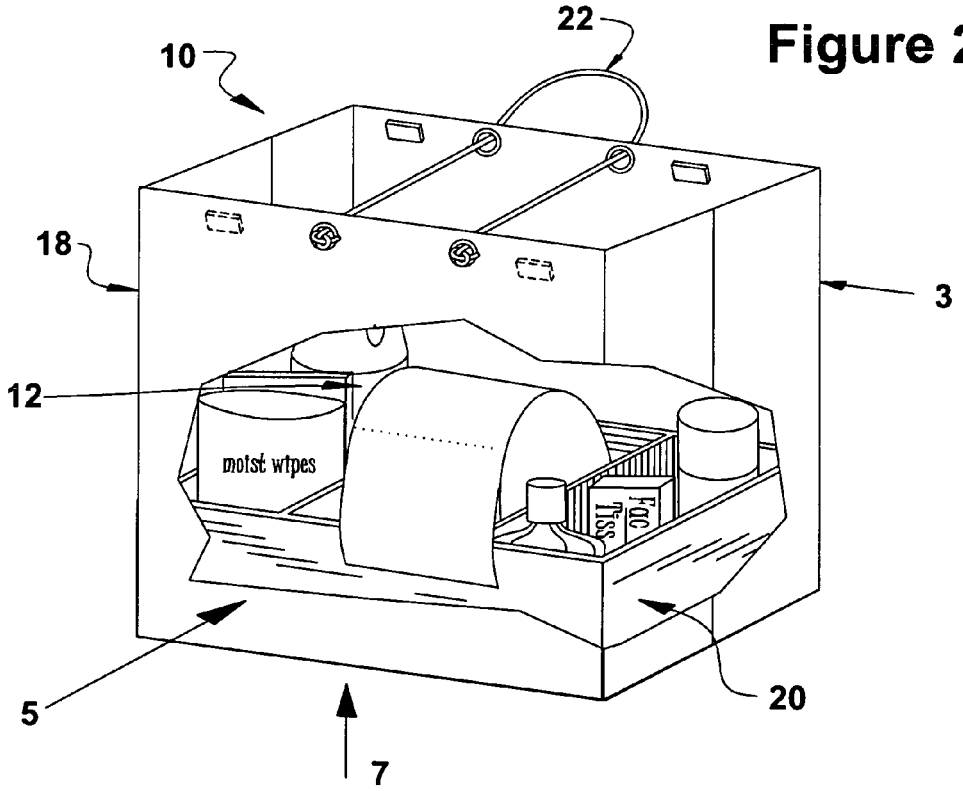

TRAVELER'S HYGIENIC TOTE

1. BACKGROUND OF THE INVENTION

A. Field of the Invention

The embodiments of the present invention relate to a carrier, and more particularly, the embodiments of the present invention relate to a portable, sanitary, and self-closing carrier for having all hygienic supplies required by a traveler using a public toilet readily accessible to the traveler in one convenient place.

B. Description of the Prior Art

Numerous innovations for carriers have been provided in the prior art, which will be described below in chronological order to show advancement in the art, and which are incorporated herein by reference thereto. Even though these innovations may be suitable for the specific individual purposes to which they address, however, they differ from the present invention in that they do not teach a portable, sanitary, and self-closing carrier for having all hygienic supplies required by a traveler using a public toilet readily accessible to the traveler in one convenient place.

(1) U.S. Pat. No. 4,718,524 to Crumley.

U.S. Pat. No. 4,718,524 issued to Crumley on Jan. 12, 1988 in U.S. class 190 and subclass 110 teaches a bag having an opening for receiving a foldable insert, which includes a pair of hingedly connected panels. Each having several pockets on opposite sides thereof. The panels are moveable between a fully open position in which they are disposed in a common plane, a fully closed position in which they are disposed adjacent one another for storage, and a partially open position in which they are adapted to be self-supporting on the edges of the two panels.

(2) U.S. Pat. No. 5,881,788 to Hersh et al.

U.S. Pat. No. 5,881,788 issued to Hersh et al. on Mar. 16, 1999 in U.S. class 150 and subclass 116 teaches a handbag including an enclosure that defines a major compartment for receiving and retaining articles, a credit card holder for holding at least one credit card, a minor compartment defined within the major compartment for reception of the credit card holder, and a connecting member for attaching the credit card holder with respect to the minor compartment in a manner which permits insertion of the credit card holder into the minor compartment and withdrawal of the credit card holder upwardly with respect to the minor compartment up to a predetermined distance as limited by the connecting member. When the credit card holder is moved upwardly, the movement provides user access to the credit cards while preventing outward movement of the credit card holder from the minor compartment a distance greater than the predetermined distance.

(3) U.S. Pat. No. 6,000,509 to Chisholm.

U.S. Pat. No. 6,000,509 issued to Chisholm on Dec. 14, 1999 in U.S. class 190 and subclass 109 teaches a suitcase including compartments for storing various types of articles in the distinct compartments. Preferably, the compartments are implemented to store in one compartment toiletries and/or cosmetics and, in the other compartment, articles of clothing or the like. In one of the compartments, removable inserts are provided having separate sub-compartments or fastening mechanisms for holding various articles and the like. The inserts are removable from the compartment and include straps for hanging same for access to the articles held by the insert.

(4) United States Patent Application Publication Number 2002/0005372 to Cook et al.

United States Patent Application Publication Number 2002/0005372 published to Cook et al. on Jan. 17, 2002 in U.S. class 206 and subclass 734 teaches a combination of a container and an elongate member in which a side panel of the container is provided with a plurality of lines of weakness. The plurality of lines of weakness can be bent into braces or a brace and a pocket. The combination of the brace and pocket can support and hold the elongate member relative to the container. The elongate member can easily be removed from the container with one hand.

(5) U.S. Pat. No. 6,491,074 to Roegner.

U.S. Pat. No. 6,491,074 issued to Roegner on Dec. 10, 2002 in U.S. class 150 and subclass 112 teaches a purse for carrying and organizing various articles with compartments, panels, pockets, and flaps shaped, sized, located, and connected to each other in a manner that allows securement of and access to articles of certain shapes, such as drinking bottles, umbrellas, eyeglasses, credit cards, and so on, while also including segregated storage spaces to allow additional storage of all kinds of other articles. The purse may be implemented as an organizing insert that can be switched between a variety of outer shells, as fashion, weather conditions, and whim dictate.

(6) U.S. Pat. No. 6,523,653 to Roegner.

U.S. Pat. No. 6,523,653 issued to Roegner on Feb. 25, 2003 in U.S. class 190 and subclass 109 teaches a portable multi-pocket organizer for a carrying case of the type having a primary shell of pliable material formed of a pair of substantially identical primary half shells connected together for hinging along a common side and forming a primary receptacle, and a multi-pocket assembly of pliable material that removably stores within the carrying case. The multi-pocket assembly device includes a rectangular pocket back panel having a front face and a back face. At least two open mesh pockets are on the front face of the pocket back panel. The open mesh pockets have openings oriented in a common direction. A removable auxiliary case is in each open mesh pocket. Each case is formed of a primary shell of pliable material. The primary shell is formed of a pair of opposed half shells connected together for hinging along a common side and forming a receptacle. Each primary shell has an outer fastener so that the outer fastener provides a way for opening and securing each auxiliary case.

(7) United States Patent Application Publication Number 2005/0218033 to Curtis.

United States Patent Application Publication Number 2005/0218033 published to Curtis on Oct. 6, 2005 in U.S. class 206 and subclass 581 teaches a compact shaving kit including a slim, crush-proof, latched, watertight, clamshell case that is constructed from tempered aluminum or other lightweight, high tensile strength material. The case contains a retention apparatus for shaving soap or cream, a shaving brush, one or more safety razors, and a storage apparatus for accessory items, such as extra razor blades, after-shave balm, or cologne. The case also includes a portable mechanical retention apparatus for the shaving brush for after-use storage in an upright, inverted position. The case may also contain a mirror. The case is dimensioned for insertion into a travel bag, toiletry bag, or suitcase.

It is apparent that numerous innovations for carriers have been provided in the prior art that are adapted to be used. Furthermore, even though these innovations may be suitable for the specific individual purposes to which they address, however, they would not be suitable for the purposes of the embodiments of the present invention as heretofore described, namely, a portable, sanitary, and self-closing carrier for having all hygienic supplies required by a traveler using a public toilet readily accessible to the traveler in one convenient place.

2. SUMMARY OF THE INVENTION

Thus, an object of the embodiments of the present invention is to provide a portable, sanitary, and self-closing carrier for having all hygienic supplies required by a traveler using a public toilet readily accessible to the traveler in one convenient place, which avoids the disadvantages of the prior art.

Briefly stated, another object of the embodiments of the present invention is to provide a portable, sanitary, and self-closing carrier for having all hygienic supplies required by a traveler using a public toilet readily accessible to the traveler in one convenient place. The carrier includes a tote bag, a tray, and a handle. The tote bag is portable and sanitary. The tray is replaceably contained within the tote bag and has all of the hygienic supplies required by the traveler using the public toilet readily accessible to the traveler in the one convenient place. The handle extends from the tote bag and is so configured so as to allow the tote bag to close when the handle is lifted during carrying so as to allow the tote bag to be self-closing.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

3. BRIEF DESCRIPTION OF THE FIGURES OF THE DRAWING

The figures of the drawing are briefly described as follows:

FIG. 2 is an enlarged diagrammatic perspective view of the area generally enclosed by the dotted curve identified by ARROW 2 in FIG. 1 of the portable, sanitary, and self-closing carrier of the embodiments of the present invention having all hygienic supplies required by a traveler using a public toilet readily accessible to the traveler in one convenient place;

FIG. 5 is a diagrammatic perspective view of the tray of the portable, sanitary, and self-closing carrier of the embodiments of the present invention having all hygienic supplies required by a traveler using a public toilet readily accessible to the traveler in one convenient place identified by ARROW 5 in FIG. 2;

4. LIST OF REFERENCE NUMERALS UTILIZED IN THE FIGURES OF THE DRAWING

Figure 1:
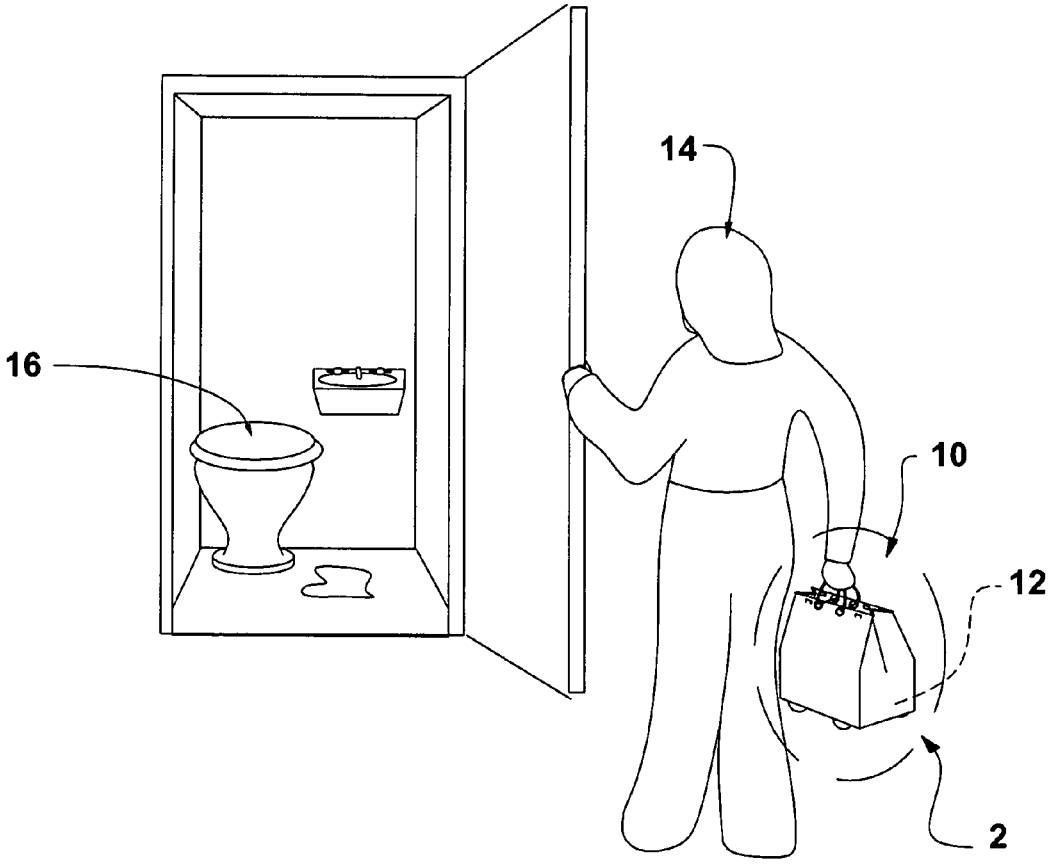
FIG. 1 is a diagrammatic perspective view of the portable, sanitary, and self-closing carrier of the embodiments of the present invention having all hygienic supplies required by a traveler using a public toilet readily accessible to the traveler in one convenient place.

A. General.

10 portable, sanitary, and self-closing carrier of embodiments of present invention for having all hygienic supplies 12 required by traveler 14 using public toilet 16 readily accessible to traveler 14 in one convenient place

12 hygienic supplies

14 traveler

16 public toilet

B. Overall Configuration of Portable, Sanitary, and Self-Closing Carrier 10.

18 tote bag

20 tray for having all of hygienic supplies 12 required by traveler 14 using public toilet 16 readily accessible to traveler 14 in one convenient place

22 handle

C. Specific Configuration of Tote Bag 18 and Handle 22.

(1) Tote bag 18.

24 bottom of tote bag 18

26 surface

28 upright standing walls of tote bag 18

30 normally open top of tote bag 18

31 feet of bottom 24 of tote bag 18 for keeping tote bag 18 off surface 26, to thereby keep tote bag 18 sanitary (2) Handle 22.

32 pair of spaced-apart through bores in each wall of pair of opposing upright standing walls 28 of tote bag 18

33 magnetic closure of tote bag 18

34 length of cord of handle 22

36 pair of ends of length of cord 34 of handle 22

38 first arrow

40 second arrow

D. Specific Configuration of Tray 20.

42 bottom of tray 20

44 upstanding peripheral wall of tray 20

46 upstanding partition walls of tray 20

48 compartments of tray 20

50 smooth semi-cylindrically shaped cradle 50 of one compartment of compartments 48 of tray 20 for cooperating with cylindrical shape of roll of toilet tissue 52 placed therein

52 roll of toilet tissue of hygienic supplies 12

54 moist wipes of hygienic supplies 12

56 toilet seat covers of hygienic supplies 12

58 air freshener of hygienic supplies 12

60 disinfectant of hygienic supplies 12

62 hand sanitizer of hygienic supplies 12

64 facial tissues of hygienic supplies 12

E. Specific configuration of feet 31.

66 corners of bottom 24 of tote bag 18

68 insert of tote bag 18

5. DETAILED DESCRIPTION OF THE PREFERRED EMBODIMENTS

A. General.

Referring now to the figures, in which like numerals indicate like parts, and particularly to FIG. 1, which is a diagrammatic perspective view of the portable, sanitary, and self-closing carrier of the embodiments of the present invention having all hygienic supplies required by a traveler using a public toilet readily accessible to the traveler in one convenient place, the portable, sanitary, and self-closing carrier of the embodiments of the present invention is shown generally at 10 for having all hygienic supplies 12 required by a traveler 14 using a public toilet 16 readily accessible to the traveler 14 in one convenient place.

B. Overall Configuration of the Portable, Sanitary, and Self-Closing Carrier 10.

The overall configuration of the portable, sanitary, and self-closing carrier 10 can best be seen in FIG. 2, which is an enlarged diagrammatic perspective view of the area generally enclosed by the dotted curve identified by ARROW 2 in FIG. 1 of the portable, sanitary, and self-closing carrier of the embodiments of the present invention having all hygienic supplies required by a traveler using a public toilet readily accessible to the traveler in one convenient place, and as such, will be discussed with reference thereto.

The portable, sanitary, and self-closing carrier 10 comprises a tote bag 18, a tray 20, and a handle 22. The tote bag 18 is portable and sanitary. The tray 20 is replaceably contained within the tote bag 18 and is for having all of the hygienic supplies 12 required by the traveler 14 using the public toilet 16 readily accessible to the traveler 14 in the one convenient place. The handle 22 extends from the tote bag 18 and is so configured so as to allow the tote bag 18 to close when the handle 22 is lifted during carrying so as to allow the tote bag 18 to be self-closing.

C. Specific Configuration of the Tote Bag 18 and the Handle 22.

The specific configuration of the tote bag 18 and the handle 22 can best be seen in FIG. 3, which is an enlarged diagrammatic perspective view of just the portable, sanitary, and self-closing carrier of the embodiments of the present invention identified by ARROW 3 in FIG. 2, and as such, will be discussed with reference thereto.

(1) Tote Bag 18.

The tote bag 18 has a bottom 24. The bottom 24 of the tote bag 18 is capable of allowing the tote bag 18 to stand upright on a surface 26.

The tote bag 18 further has upright standing walls 28. The upright standing walls 28 of the tote bag 18 extend upwardly from the bottom 24 of the tote bag 18 to a normally open top 30.

The bottom 24 of the tote bag 18 has feet 31 depending therefrom. The feet 31 of the bottom 24 of the tote bag 18 are for keeping the tote bag 18 off the surface 26, to thereby keep the tote bag 18 sanitary.

The normally open top 30 of the tote bag 18 is kept selectively closed by a magnetic closure 33.

(2) Handle 22.

The handle 22 has each wall of a pair of opposing upright standing walls 28 of the tote bag 18 having a pair of spaced-apart through bores 32, in proximity to the normally open top 30 of the tote bag 18.

The handle 22 further has a length of cord 34. The length of cord 34 of the handle 22 has a pair of ends 36. The pair of ends 36 of the length of cord 34 of the handle 22 extend freely through the pair of spaced-apart through bores 32 in one wall of the pair of opposing upright standing walls 28 of the tote bag 18, respectively, and are affixed at the pair of spaced-apart through bores 32 in the other wall of the pair of opposing upright standing walls 28 of the tote bag 18 so when the length of cord 34 of the handle 22 is lifted during carrying, the other wall of the pair of opposing upright standing walls 28 of the tote bag 18 is drawn towards the one wall of the pair of opposing upright standing walls 28 of the tote bag 18, as shown by a first arrow 38, and in doing so, closes the normally open top 30 of the tote bag 18, as shown by a second arrow 40.

D. Specific Configuration of the Tray 20.

Figure 3:
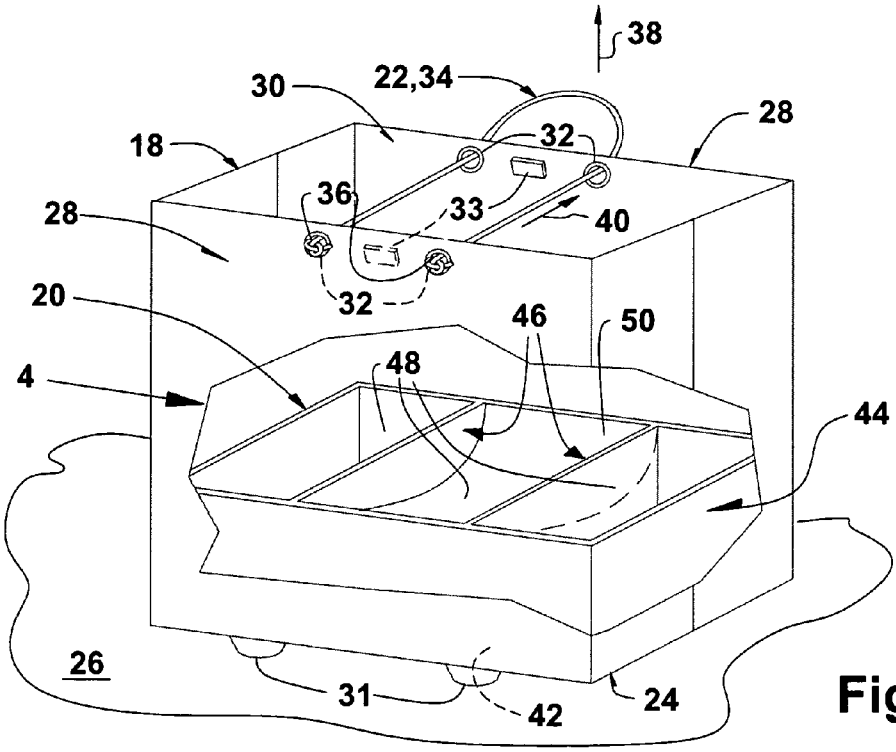
FIG. 3 is an enlarged diagrammatic perspective view of just the portable, sanitary, and self-closing carrier of the embodiments of the present invention identified by ARROW 3 in FIG. 2.
Figure 4:
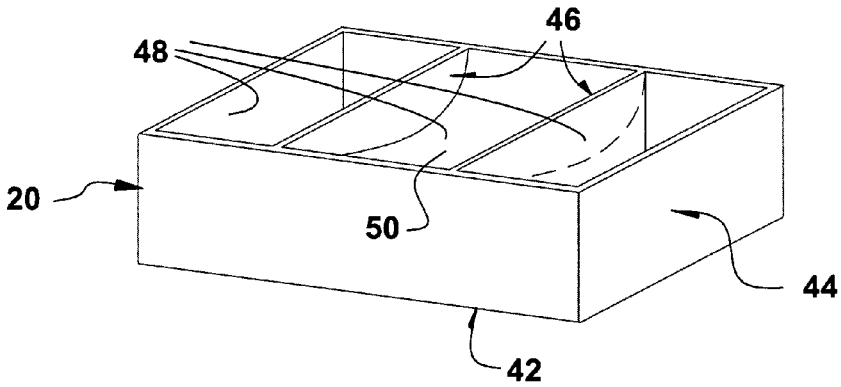
FIG. 4 is a diagrammatic perspective view of just the tray of the portable, sanitary, and self-closing carrier of the embodiments of the present invention identified by ARROW 4 in FIG. 3.

The specific configuration of the tray 20 can best be seen in FIGS. 3-6, which are, respectively, an enlarged diagrammatic perspective view of just the portable, sanitary, and self-closing carrier of the embodiments of the present invention identified by ARROW 3 in FIG. 2, a diagrammatic perspective view of just the tray of the portable, sanitary, and self-closing carrier of the embodiments of the present invention identified by ARROW 4 in FIG. 3, a diagrammatic perspective view of the tray of the portable, sanitary, and self-closing carrier of the embodiments of the present invention having all hygienic supplies required by a traveler using a public toilet readily accessible to the traveler in one convenient place identified by ARROW 5 in FIG. 2, and an exploded diagrammatic perspective view of the tray of the portable, sanitary, and self-closing carrier of the embodiments of the present invention having all hygienic supplies required by a traveler using a public toilet readily accessible to the traveler in one convenient place identified by ARROW 6 in FIG. 5, and as such, will be discussed with reference thereto.

The tray 20 has a bottom 42. The bottom 42 of the tray 20 is sized and configured to replaceably rest on the bottom 24 of the tote bag 18.

The tray 20 further has an upstanding peripheral wall 44. The upstanding peripheral wall 44 of the tray 20 extends upwardly from around the bottom 42 of the tray 20.

The tray 20 further has upstanding partition walls 46. The upstanding partition walls 46 of the tray 20 extend upwardly from the bottom 42 of the tray 20 to form compartments 48.

One compartment 48 of the tray 20 is a smooth semi-cylindrically shaped cradle 50 for cooperating with a cylindrical shape of a roll of toilet tissue 52 of the hygienic supplies 12 placed therein, to thereby allow the roll of toilet tissue 52 of the hygienic supplies 12 to unwind while still remaining in the semi-cylindrically shaped cradle 50 of the one compartment 48 of the tray 20.

Figure 6:
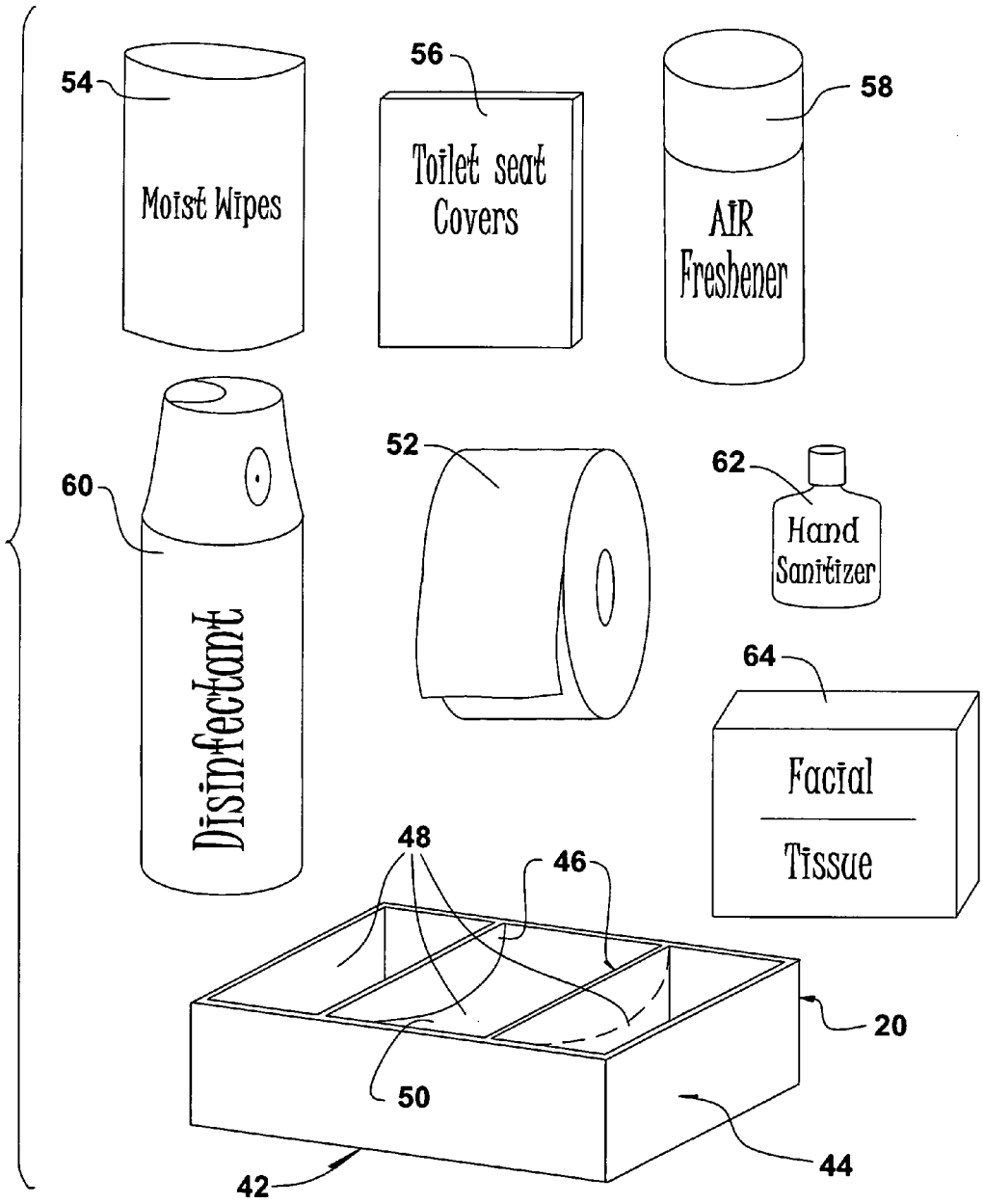
FIG. 6 is an exploded diagrammatic perspective view of the tray of the portable, sanitary, and self-closing carrier of the embodiments of the present invention having all hygienic supplies required by a traveler using a public toilet readily accessible to the traveler in one convenient place identified by ARROW 6 in FIG. 5.

As best shown in FIGS. 5 and 6, the hygienic supplies 12 required by the traveler 14 using the public toilet 16 comprise moist wipes 54, toilet seat covers 56, an air freshener 58, a disinfectant 60, the roll of toilet tissue 52, a hand sanitizer 62, and facial tissues 64.

The tray 20 is made from a material selected from the group consisting of plastic, pressed cardboard, metal, and combinations thereof.

E. Specific Configuration of the Feet 31.

Figure 7:
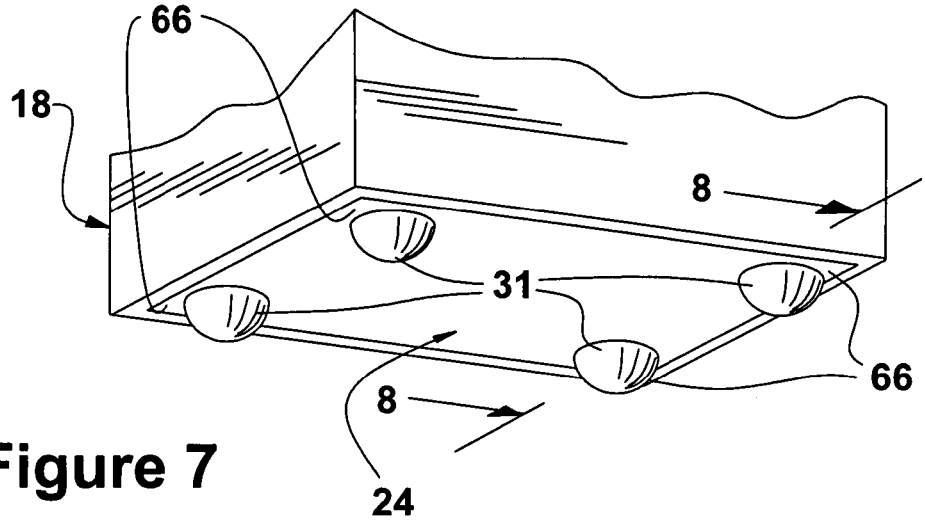
FIG. 7 is a diagrammatic perspective view taken generally in the direction of ARROW 7 in FIG. 2 of the feet of the tote bag of the portable, sanitary, and self-closing carrier of the embodiments of the present invention.
Figure 8:
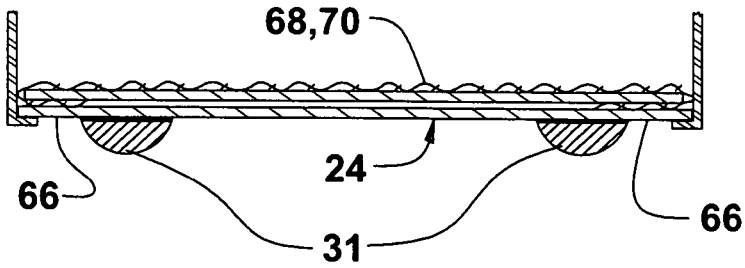
FIG. 8 is an enlarged diagrammatic cross sectional view taken along LINE 8-8 in FIG. 7.

The specific configuration of the feet 31 can best be seen in FIGS. 7 and 8, which are, respectively, a diagrammatic perspective view taken generally in the direction of ARROW 7 in FIG. 2 of the feet of the tote bag of the portable, sanitary, and self-closing carrier of the embodiments of the present invention, and an enlarged diagrammatic cross sectional view taken along LINE 8-8 in FIG. 7, and as such, will be discussed with reference thereto.

Each foot 31 is hemispherically shaped, and depends from a corner 66 of the bottom 24 of the tote bag 18, respectively.

An insert 68 of the tote bag 18 reinforces the bottom 24 of the tote bag 18, and is made of a piece of material covered cardboard 70 so as not to damage the bottom 24 of the tote bag 18.

F. Impressions.

It will be understood that each of the elements described above or two or more together may also find a useful application in other types of constructions differing from the types described above.

While the embodiments of the present invention have been illustrated and described as embodied in a portable, sanitary, and self-closing carrier for having all hygienic supplies required by a traveler using a public toilet readily accessible to the traveler in one convenient place, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A portable, and self-closing carrier, comprising:

a) a tote bag;

b) a tray; and c) a handle;

wherein said tote bag is portable;

wherein said tote bag has a normally open top;

wherein said tray is replaceably contained within said tote bag;

wherein said tray is accessible through said normally open top of said tote bag;

wherein said handle extends from said tote bag; and wherein said handle allows said tote bag to close when said handle is lifted during carrying so as to allow said tote bag to be self-closing, wherein said bottom of said tote bag has feet depending therefrom; and wherein said feet of said bottom of said bag are for keeping said tote bag off the surface, to thereby keep said tote bag sanitary.

2. The carrier of claim 1, wherein said tote bag has upright standing walls; and wherein said upright standing walls of said tote bag extend upwardly from said bottom of said tote bag to said normally open top.

3. The carrier of claim 2, wherein said handle has each wall of a pair of opposing upright standing walls of said tote bag having a pair of spaced-apart through bores, in proximity to said normally open top of said tote bag.

4. The carrier of claim 3, wherein said handle has a length of cord.

5. The carrier of claim 4, wherein said length of cord of said handle has a pair of ends; and wherein said pair of ends of said length of cord of said handle extend freely through said pair of spaced-apart through bores in one wall of said pair of opposing upright standing walls of said tote bag, respectively, and are affixed at said pair of spaced-apart through bores in the other wall of said pair of opposing upright standing walls of said tote bag so when said length of cord of said handle is lifted during carrying, said other wall of said pair of opposing upright standing walls of said tote bag is drawn towards said one wall of said pair of opposing upright standing walls of said tote bag, and in doing so, closes said normally open top of said tote bag.

6. A portable, and self-closing carrier, comprising:

a) a tote bag;

b) a tray; and c) a handle;

wherein said tote bag is portable;

wherein said tote bag has a normally open top;

wherein said tray is replaceably contained within said tote bag;

wherein said tray is accessible through said normally open top of said tote bag;

wherein said handle extends from said tote bag; and wherein said handle allows said tote bag to close when said handle is lifted during carrying so as to allow said tote bag to be self-closing, wherein said tray has a bottom;

wherein said bottom of said tray is sized and configured to replaceably rest on said bottom of said tote bag;

wherein said tray has an upstanding peripheral wall;

wherein said upstanding peripheral wall of said tray extends upwardly from around said bottom of said tray;

wherein said tray has upstanding partition walls;

wherein said upstanding partition walls of said tray extend upwardly from said bottom of said tray to form compartments; and wherein one compartment of said tray is a smooth semi-cylindrically shaped cradle.

7. The carrier of claim 1, wherein said tray is made from a material selected from the group consisting of plastic, pressed cardboard, metal, and combinations thereof.

8. The carrier of claim 1, wherein each foot is hemispherically shaped; and wherein each foot depends from a corner of said bottom of said tote bag, respectively.

9. The carrier of claim 1, wherein said tote bag has an insert; and wherein said insert of said tote bag reinforces said bottom of said tote bag.

10. The carrier of claim 9, wherein said insert of said tote bag is made of a piece of material covered cardboard so as not to damage said bottom of said tote bag.

11. The carrier of claim 2, wherein said normally open top of said tote bag is kept selectively closed by a magnetic closure.

12. The carrier of claim 6, wherein said tote bag has upright standing walls; and wherein said upright standing walls of said tote bag extend upwardly from said bottom of said tote bag to said normally open top.

13. The carrier of claim 12, wherein said handle has each wall of a pair of opposing upright standing walls of said tote bag having a pair of spaced-apart through bores, in proximity to said normally open top of said tote bag.

14. The carrier of claim 13, wherein said handle has a length of cord.

15. The carrier of claim 14, wherein said length of cord of said handle has a pair of ends; and wherein said pair of ends of said length of cord of said handle extend freely through said pair of spaced-apart through bores in one wall of said pair of opposing upright standing walls of said tote bag, respectively, and are affixed at said pair of spaced-apart through bores in the other wall of said pair of opposing upright standing walls of said tote bag so when said length of cord of said handle is lifted during carrying, said other wall of said pair of opposing upright standing walls of said tote bag is drawn towards said one wall of said pair of opposing upright standing walls of said tote bag, and in doing so, closes said normally open top of said tote bag.

16. The carrier of claim 6, wherein said tray is made from a material selected from the group consisting of plastic, pressed cardboard, metal, and combinations thereof.

17. The carrier of claim 6, wherein each foot is hemispherically shaped; and wherein each foot depends from a corner of said bottom of said tote bag, respectively.

18. The carrier of claim 6, wherein said tote bag has an insert; and wherein said insert of said tote bag reinforces said bottom of said tote bag.

19. The carrier of claim 18, wherein said insert of said tote bag is made of a piece of material covered cardboard so as not to damage said bottom of said tote bag.

* * * * *